US010482702B2

(12) United States Patent
Mizumoto

(10) Patent No.: US 10,482,702 B2
(45) Date of Patent: Nov. 19, 2019

(54) MONEY HANDLING APPARATUS

(71) Applicant: GLORY LTD., Himeji-shi, Hyogo (JP)

(72) Inventor: Koji Mizumoto, Himeji (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/238,775

(22) Filed: Aug. 17, 2016

(65) Prior Publication Data

US 2017/0053471 A1 Feb. 23, 2017

(30) Foreign Application Priority Data

Aug. 20, 2015 (JP) ..... 2015-162565

(51) Int. Cl.
*G07D 11/60* (2019.01)
*G07D 11/50* (2019.01)
*G07D 11/00* (2019.01)

(52) U.S. Cl.
CPC ..... *G07D 11/50* (2019.01); *G07D 11/0087* (2013.01); *G07D 11/60* (2019.01)

(58) Field of Classification Search
CPC ..... G07D 11/00; G07D 11/0021; G07D 11/0081; G07D 11/0084; G07D 11/0087; G07D 11/0003; G07D 11/16; G07D 11/40; G07D 11/50; G07D 11/60; G07D 11/10
USPC ..... 194/206, 207; 209/534; 235/379
See application file for complete search history.

(56) References Cited

U.S. PATENT DOCUMENTS 5,938,044 A * 8/1999 Weggesser ..... G07D 7/04 209/534
7,896,149 B2 * 3/2011 Tabata ..... G07D 1/02 194/217
2001/0013456 A1 8/2001 Ishida et al.
2002/0056605 A1 * 5/2002 Mazur ..... C12Q 1/37 194/207
2003/0015395 A1 * 1/2003 Hallowell ..... G07D 7/00 194/206

(Continued)

FOREIGN PATENT DOCUMENTS

JP 2005-258737 A 9/2005
JP 2006-107061 A1 4/2006
JP 2013-88896 A 5/2013

OTHER PUBLICATIONS

"Bureau of Engraving and Printing", "Currency Notes" at www.moneyfactory.gov (Year: 2018).*

(Continued)

*Primary Examiner* — Jeffrey A Shapiro

(74) *Attorney, Agent, or Firm* — Renner, Kenner, Greive, Bobak, Taylor & Weber

(57) ABSTRACT

An objective of the present invention is to facilitate the setting of versions of money to be stacked in stacking units of a money handling apparatus. The money handling apparatus includes: a plurality of stacking units that stack money by type; a storage unit that stores a version classification setting in which classification of versions of multiple series of money issued in different years is set for each denominations; a recognition unit that recognizes denominations and series of money; and a control unit that determines, on the basis of the version classification setting, versions of money of which denominations and series have been recognized by the recognition unit, and stacks the money in the stacking units corresponding to the denominations and versions of the money.

6 Claims, 6 Drawing Sheets

(56) References Cited

U.S. PATENT DOCUMENTS

2003/0121077 A1* 6/2003 Katou ..... G07D 7/181 235/12
2004/0182675 A1* 9/2004 Long ..... B65H 39/10 194/206
2005/0060059 A1* 3/2005 Klein ..... G06Q 40/12 700/213
2005/0060061 A1* 3/2005 Jones ..... G07D 11/0084 700/226
2005/0241909 A1* 11/2005 Mazur ..... G06M 7/06 194/207
2006/0076212 A1* 4/2006 Kuroda ..... G07D 11/00 194/206
2008/0060906 A1* 3/2008 Fitzgerald ..... G07D 11/0081 194/207
2009/0087076 A1* 4/2009 Jenrick ..... G07D 7/00 382/135
2011/0314773 A1* 12/2011 Suzuki ..... G07D 11/0081 53/399
2012/0011813 A1* 1/2012 Nakai ..... B65B 27/08 53/447
2012/0150745 A1* 6/2012 Csulits ..... G07D 7/00 705/45
2013/0220897 A1* 8/2013 Asada ..... B07C 5/34 209/534
2015/0178692 A1* 6/2015 Nishida ..... G07D 11/0003 705/45
2015/0221158 A1* 8/2015 Nakashima ..... G07D 11/0084 194/206

OTHER PUBLICATIONS

"US Bureau of Printing and Engraving—$5 Note" (Year: 2018).*
Wikipedia, "Federal Reserve Note" article. (Year: 2018).*
JPO, Office Action in Japanese Patent Application No. 2015-162565 (counterpart to U.S. Appl. No. 15/238,775), dated Aug. 20, 2019, 3 pgs.

* cited by examiner

FIG. 4

| | 10,000-yen | 5,000-yen | 2,000-yen | 1,000-yen |
|---|---|---|---|---|
| Series | Series-E note | Series-E note | - | Series-E note |
| | Series-D note | Series-D note | Series-D note | Series-D note |
| | Series-C note | Series-C note | - | Series-C note |
| | - | - | - | Series-B note |

FIG. 5A

| | 10,000-yen | 5,000-yen | 2,000-yen | 1,000-yen |
|---|---|---|---|---|
| New version note | Series-E note<br>Series-D note | Series-E note<br>Series-D note | Series-D note | Series-E note |
| Old version note | Series-C note | Series-C note | - | Series-D note<br>Series-C note<br>Series-B note |

FIG. 5B

| | 10,000-yen | 5,000-yen | 2,000-yen | 1,000-yen |
|---|---|---|---|---|
| New version note | Series-E note | Series-E note<br>Series-D note | Series-D note | Series-E note |
| Old version note | Series-D note | - | - | Series-D note |
| Older version note | Series-C note | Series-C note | - | Series-C note<br>Series-B note |

FIG. 7

| | First stacking unit | Second stacking unit | Third stacking unit | Fourth stacking unit | First reject unit | Second reject unit |
|---|---|---|---|---|---|---|
| Stacking pattern 1 | New version 10,000-yen note | New version 5,000-yen note | New version 1,000-yen note | New version 1,000-yen note | Undesignated note (2,000-yen, old version note) | Counterfeit note, unrecognizable note, suspect note |
| Stacking pattern 2 | New version 1,000-yen note | New version 1,000-yen note | Old version 1,000-yen note | Older version 1,000-yen note | Undesignated note (10,000-yen, 5,000-yen, 2,000-yen) | Counterfeit note, unrecognizable note, suspect note |
| ⋮ | | | | | | |

MONEY HANDLING APPARATUS

CROSS-REFERENCE TO RELATED APPLICATION

The disclosure of Japanese Patent Application No. 2015-162565, filed on Aug. 20, 2015, is incorporated herein by reference.

BACKGROUND OF THE INVENTION

Field of the Invention

The present invention relates to a money handling apparatus which recognizes the type of money and handles the money.

Description of the Background Art

Conventionally, a money handling apparatus has been utilized which recognizes the denomination, authenticity, version (old/new), fitness, and the like of each of banknotes and coins, and handles the banknotes and the coins. When a change of banknote design, recoinage, or issuance of new banknotes or coins is performed, a new series of new version money is circulated in the market. Even in this situation, while an old series of old version money is still circulating in the market, the money handling apparatus handles both the new version money and the old version money.

Japanese Laid-Open Patent Publication No. 2001-229454 (Patent Literature 1) discloses a money handling apparatus in which, when new design coins are issued, both the new design coins and the old design coins are set as an object to be handled, but the object to be handled can be changed to only the new design coins when the number of the old design coins handled within a predetermined period of time decreases. Meanwhile, Japanese Laid-Open Patent Publication No. 2013-088896 (Patent Literature 2) discloses an automated teller machine in which, for each of a plurality of storage units, the denomination, year of issuance, and the like of banknotes to be stored therein can be set.

In financial facilities, in order to promote circulation of new version money which is newly issued, when the new version money is received by a money handling apparatus, the new version money is stored in the apparatus to be reused for dispensing or the like, whereas, when old version money is received by the money handling apparatus, the old version money is not reused for dispensing or the like but is stored in the apparatus as an object to be collected.

SUMMARY OF THE INVENTION

In the conventional art described above, however, the setting operation relating to new version money and old version money in the money handling apparatus is complicated. For example, in a financial facility located in an urban area, a lot of new version money is handled immediately after issuance thereof, and therefore old version money can be collected while reusing only the new version money. In contrast, in a financial facility located in a rural area, circulation of new version money is small for a while after issuance thereof, and shortage of money to be dispensed may occur if money to be reused is limited to the new version money. Therefore, in financial facilities, settings of the money handling apparatus need to be changed on the basis of determination as to whether the old version money is reused or collected in accordance with circulation of the new version money.

Utilizing the technique disclosed in Patent Literature 1 enables automatic setting so as to stop reuse of the old version money upon detecting an increase in circulation of the new version money. However, reuse of the old version money might be stopped by, for example, an unusual concentration of use of the new version money in a short period of time. If reuse of the old version money is stopped by circulation of the new version money being insufficient, a shortage of money to be reused occurs, and therefore an operation to restore the setting so as to reuse the old version money is needed. On the other hand, utilizing the apparatus disclosed in Patent Literature 2 allows a user of the apparatus to judge circulation of the new version money and perform a setting as to whether only the new version money should be stored in a storage unit for money to be reused or both the new version money and the old version money should be stored in the storage unit. In this case, however, it is necessary for the user to set, for each of the plurality of storage units, a denomination of money to be stored therein, and further perform setting as to whether or not the old version money should also be stored in the storage unit, which is troublesome for the user.

The present invention is made to solve the aforementioned problems of the conventional art, and an object of the present invention is to provide a money handling apparatus capable of easily setting versions of money to be stacked in stacking units of the money handling apparatus.

In order to solve the above problems and achieve the above object, a money handling apparatus according to the present invention includes: a plurality of stacking units that stack money by type; a storage unit that stores version classification setting in which classification of versions of multiple series of money issued in different years is set for each denomination; a recognition unit that recognizes denominations and series of money; and a control unit that determines, on the basis of the version classification setting, versions of money of which denominations and series have been recognized by the recognition unit, and stacks the money in the stacking units corresponding to the denominations and versions of the money.

According to the present invention, in the invention described above, when multiple series of money of the same denomination are classified as new version money by the version classification setting, the control unit, on the basis of the version classification setting, stacks multiple series of money which have been classified as different series of money by the recognition unit, as new version money, in a stacking unit corresponding to the new version money among the plurality of stacking units.

According to the present invention, in the invention described above, in the version classification setting, money of the same denomination can be classified into three or more versions.

According to the present invention, in the invention described above, the storage unit stores a stacking setting in which denominations and versions of money to be stacked in the respective stacking units are set. The control unit determines, on the basis of the stacking setting, the stacking units in which the money is to be stacked after the control unit determines the versions of money on the basis of the version classification setting.

According to the present invention, in the invention described above, the money handling apparatus further includes an operation unit that designates classification of versions in the version classification setting. When classification of versions of multiple series of money is designated by the operation unit, the control unit confirms whether or not there is an inconsistency between the order of the designated versions and the order of issuance of the respective series of money, and makes a notification of the inconsistency, if any.

According to the present invention, in the invention described above, the control unit registers a designated content in the version classification setting only when there is no inconsistency between the order of the versions designated by the operation unit and the order of issuance of the respective series of money.

According to the present invention, since the version classification setting, in which classification of versions for multiple series of money of the same denomination is set, can be utilized, it is easy to determine, for money of each denomination, which series is to be handled as new version money. For example, when amount of new series money is not sufficient, the new series money and old series money are designated to be handled as new version money in the version classification setting, whereby in the money handling apparatus, and are stacked in the same stacking unit. When only the new series money is desired to be handled as new version money, it is only necessary to change the version classification in the version classification setting, thereby facilitating the operation to change the setting.

According to the present invention, in the version classification setting, classification of versions can be designated for each denomination, and multiple series of money can be set to be handled as new version money. For example, after issuance of new series money, if circulation of money of a certain denomination is small, both the new series money and the old series money of this denomination can be handled as new version money. On the other hand, if the circulation of money of a certain denomination is large, only the new series money of this denomination can be handled as new version money.

BRIEF DESCRIPTION OF THE DRAWINGS

FIG. 4 shows series of denominations of Japanese banknotes;

FIG. 5A shows a specific example of a version classification setting;

FIG. 5B shows a specific example of another version classification setting;

FIG. 7 shows a specific example of a stacking setting.

DESCRIPTION OF THE PREFERRED EMBODIMENTS

A money handling apparatus according to the present invention will be described in detail below with reference to the accompanying drawings. The money handling apparatus is capable of handling coins and banknotes. Since the handling of coins is similar to the handling of banknotes, an exemplary case in which the banknote handling apparatus handles banknotes will be described in this embodiment. Although the money handling apparatus is capable of handling currencies of various countries, an exemplary case in which the money handling apparatus handles Japanese banknotes will be described below.

Figure 1:
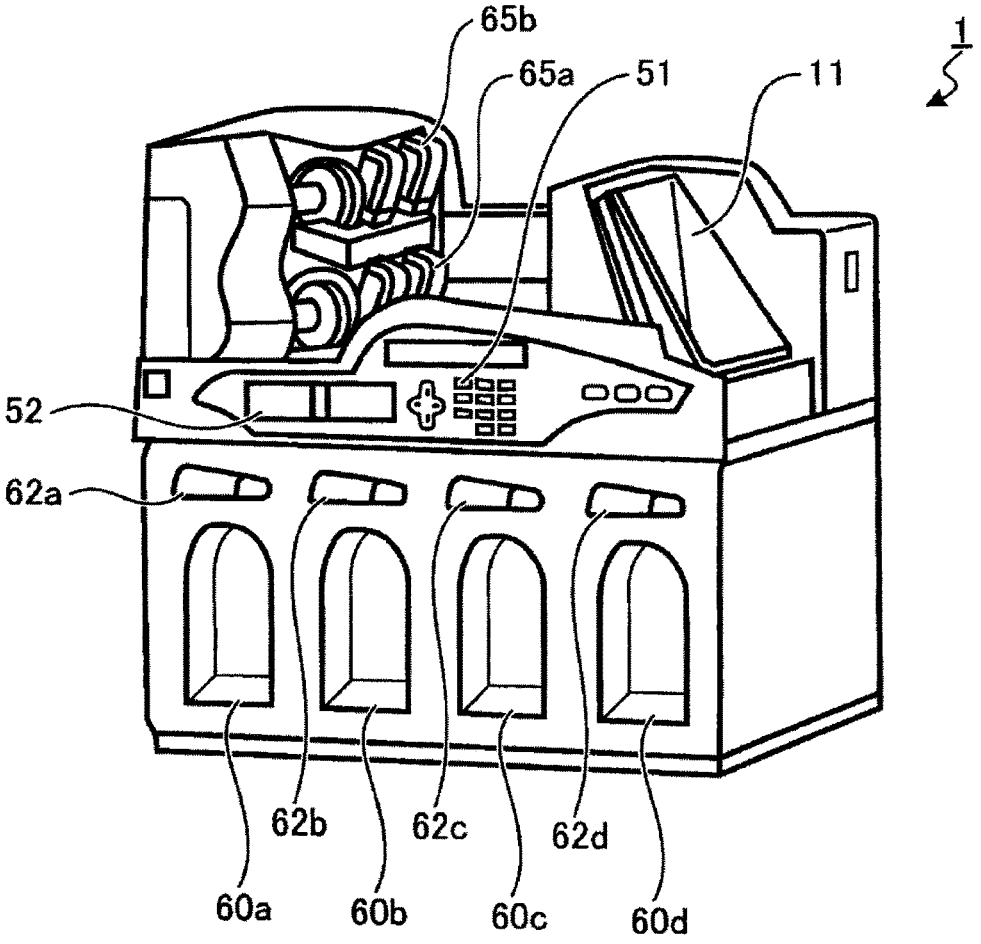
FIG. 1 is a perspective view showing an external appearance of a banknote handling apparatus according to an embodiment of the present invention.
Figure 2:
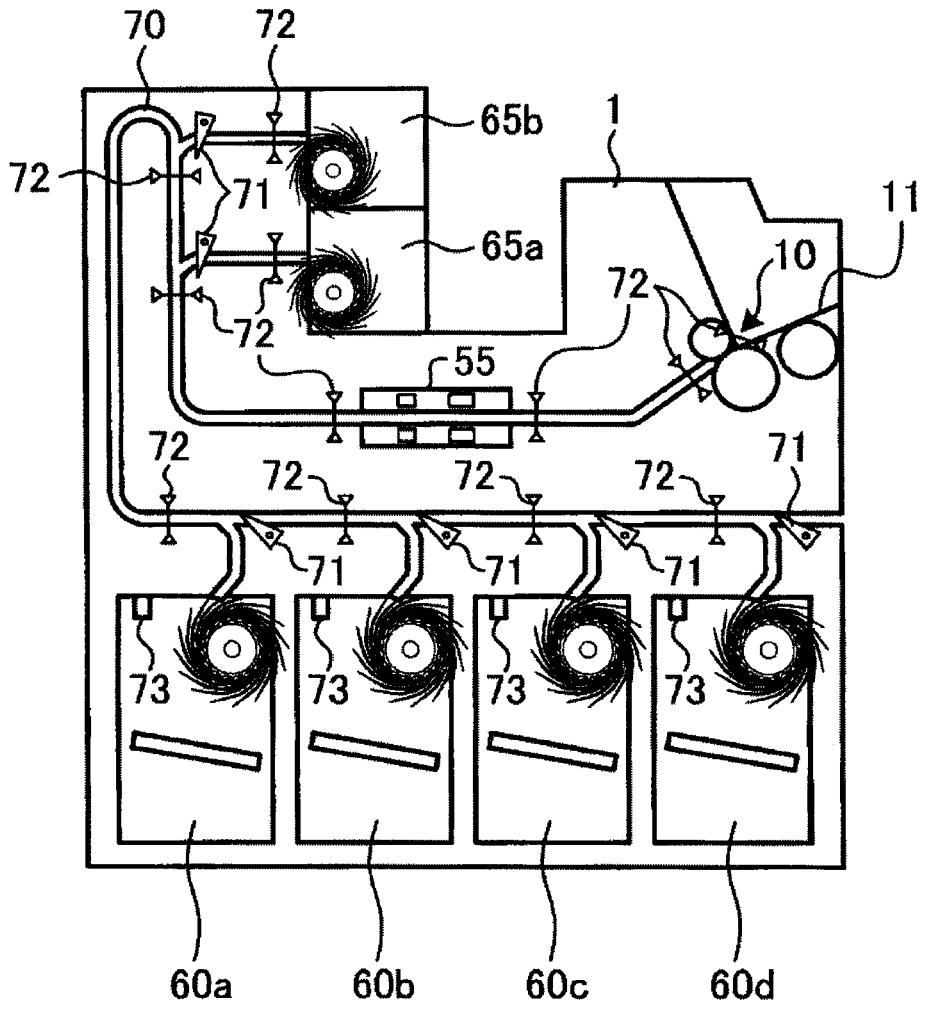
FIG. 2 is a schematic cross-sectional view showing an internal structure of the banknote handling apparatus.

FIG. 1 is a perspective view showing an external appearance of a banknote handling apparatus 1 according to the present embodiment. FIG. 2 is a schematic cross-sectional view schematically showing an internal structure of the banknote handling apparatus 1. The banknote handling apparatus 1 includes a reception unit 11 in which a plurality of banknotes can be placed, and a taking-in unit 10 which takes, the plurality of banknotes placed in the reception unit 11 into the apparatus one by one. On a front face of the apparatus, an operation unit 51 and a display unit 52 are provided. The operation unit 51 allows input of various types of information when a setting operation, an instruction operation, and/or the like are performed. The display unit 52 displays various types of information when setting information, handling results, and the like are confirmed.

As shown in FIG. 2, inside the banknote handling apparatus 1, a transport unit 70 and a recognition unit 55 are provided. The transport unit 70 transports the banknotes taken into the apparatus by the taking-in unit 10 along a transport path. The recognition unit 55 recognizes and counts the banknotes being transported by the transport unit 70.

The recognition unit 55 has a function of recognizing the denomination, version (old/new), orientation, authenticity, fitness, and/or the like of each of the banknotes transported by the transport unit 70, and counting the banknotes. The orientation is information indicating the face of the banknote (face/back) and the orientation of the banknote (portrait-upright/portrait-inverted). The authenticity is information indicating whether the banknote is a genuine banknote (genuine note) or a counterfeit banknote (counterfeit note). The fitness is information obtained by determining the degree of damage to the banknote on the basis of predetermined conditions. For example, a banknote to be reused in the market is determined as a fit note, and a banknote unsuitable for reuse in the market is determined as an unfit note. Specific examples of the denomination and the version will be described later.

The banknote handling apparatus 1 is provided with two reject units 65 (65*a* and 65*b*). On the basis of the result of recognition by the recognition unit 55, the following banknotes are rejected: an unrecognizable note; an undesignated note which is a banknote of a type other than banknote types designated to be stacked in the stacking units 60 (60*a* to 60*d*); a counterfeit note which appears to be a counterfeit banknote; a suspect note which is suspected to be a counterfeit note but cannot be determined as to authenticity; and the like. These rejected banknotes can be sorted by the reasons of rejection and stacked in a first reject unit 65*a* and a second reject unit 65*b*.

The banknote handling apparatus 1 is provided with four stacking units 60*a* to 60*d*. On the basis of the result of recognition by the recognition unit 55, the rejected banknotes such as undesignated notes are stacked in the reject units 65, whereas the banknotes of the types designated to be stacked in the stacking units 60 are sorted by the types thereof and stacked in the respective stacking units 60*a* to 60*d* as designated notes. The types of the banknotes to be stacked in the respective stacking units 60*a* to 60*d* can be set as stacking settings in advance.

As shown in FIG. 1, each stacking unit 60 has an opening at a front face thereof, and a user who uses the banknote handling apparatus 1 is allowed to take out banknotes stacked in the stacking unit 60 through the opening. In addition, on the front face of the apparatus, individual display units 62 (62*a* to 62*d*) each displaying information about the stacked banknotes are provided so as to correspond to the first stacking unit 60*a* to the fourth stacking unit 60*d*, respectively, so that the user can recognize the type of the banknotes stacked in each stacking unit 60.

Further, as shown in FIG. 2, the first stacking unit 60*a* to the fourth stacking unit 60*d* are each provided with a sensor 73 which detects whether or not stacked banknotes are present in the stacking unit, thereby detecting the removal of banknotes. Likewise, the reception unit 11 is provided with a sensor 72 which detects that banknotes are placed therein, and that all the placed banknotes are fed into the apparatus. Although not shown in FIG. 2, each reject unit 65 is also provided with a sensor which detects whether or not banknotes are present in the reject unit, thereby detecting that rejected banknotes are stacked therein, and that the rejected banknotes are taken out therefrom.

As shown in FIG. 2, the transport unit 70 is provided with a plurality of diverters 71 which diverge banknotes. In addition, the transport unit 70 is provided with a plurality of sensors 72 which detect banknotes. After the recognition unit 55 recognizes a banknote, a control unit 50 determines, on the basis of the result of recognition, a stacking destination to which the banknote should be transported and stacked, from among the four stacking units 60*a* to 60*d* and the two reject units 65*a* and 65*b*. Then, the control unit 50 controls the diverging operation of the diverters 71 while causing the sensor 72 to detect the position where the banknote is being transported, whereby the banknote is transported to the determined stacking destination and stacked therein.

Figure 3:
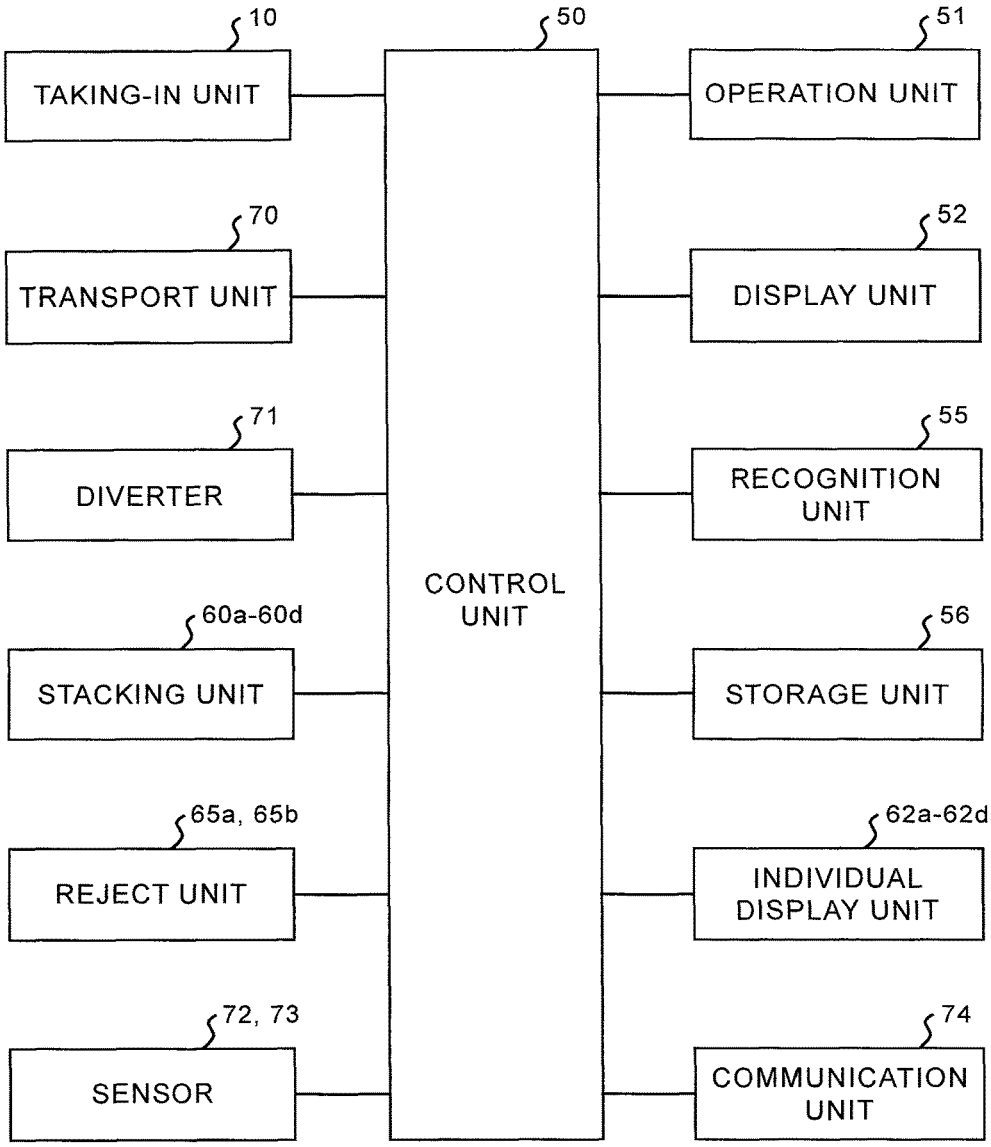
FIG. 3 is a block diagram showing a functional structure of the banknote handling apparatus.

FIG. 3 is a block diagram schematically showing a functional structure of the banknote handling apparatus 1. As shown in FIG. 3, in addition to the aforementioned structure, the banknote handling apparatus 1 includes: the control unit 50 which controls the respective units to realize functions and operations described below; a storage unit 56 in which various data, such as programs and settings, required for the operation of the control unit 50 are stored; and a communication unit 74 for communication with external devices such as a host terminal and a server.

Next, the operation of the banknote handling apparatus 1 will be described. FIG. 4 is a diagram showing series of each denomination of Japanese banknotes. Here, "series" represents banknotes of each denomination which were issued during a certain period of time due to design change or the like, and banknotes of a denomination which is newly added. Specifically, for example, series-E banknotes include 10,000-yen notes, 5,000-yen notes, and 1,000-yen notes which were issued in 2004. Series-D banknotes include 10,000-yen notes, 5,000-yen notes, and 1,000-yen notes which were issued in 1984, and 2,000-yen notes issued in 2000. Series-C banknotes include 10,000-yen notes issued in 1958, 5,000-yen notes issued in 1957, and 1,000-yen notes issued in 1963.

As shown in FIG. 4, as for 10,000-yen notes and 5,000-yen notes, there are three series of banknotes, i.e., series-C notes, series-D notes, and series-E notes. As for 1,000-yen notes, there are four series of banknotes, i.e., series-B notes, series-C notes, series-D notes, and series-E notes. As for 2,000-yen notes, there is only one series of banknotes, i.e., series-D notes. In the conventional money handling apparatus, usually, series-E 10,000-yen notes, series-E 5,000-yen notes and series-E 1,000-yen notes, and series-D 2,000-yen notes are handled as new version notes, while series-C 10,000-yen notes and series-D 10,000-yen notes, series-C 5,000-yen notes and series-D 5,000-yen notes, and series-B 1,000-yen notes, series-C 1000-yen notes and series-D 1000-yen notes are handled as old version notes. That is, only the latest series of banknotes among the multiple series of banknotes of each denomination are handled as new version notes, while all the other series of banknotes are handled as old version banknotes.

In contrast to the conventional apparatus, in the banknote handling apparatus 1, classification into new version notes and old version notes can be freely changed. Specifically, in the banknote handling apparatus 1, version classification setting can be utilized in which, as for multiple series of banknotes issued in different years, classification of versions thereof is set for each denomination. When the series to which a banknote belongs is recognized by the recognition unit 55, the control unit 50 determines the version of this banknote on the basis of the result of recognition, with reference to the version classification setting.

FIGS. 5A and 5B show specific examples of the version classification setting. According to the version classification setting, as shown in FIG. 5A, banknotes are classified into new version notes and old version notes, and the series to be handled the new version notes and the series to be handled the old version notes can be designated for each denomination. Alternatively, as shown in FIG. 5B, banknotes are classified into new version notes, old version notes, and older version notes, and the series to be handled as the new version notes, the series to be handled as the old version notes, and the series to be handled as the older version notes, which are older than the old version notes, may be designated for each denomination.

For example, when the result of recognition by the recognition unit 55 is that a banknote is a series-D 10,000-yen note, if the version classification setting is as shown in FIG. 5A, the control unit 50 determines that this banknote is a new version 10,000-yen note. On the other hand, if the version classification setting is as shown in FIG. 5B, the control unit 50 determines that this banknote is an old version 10,000-yen note.

According to the version classification setting shown in FIG. 5A, when the result of recognition by the recognition unit 55 is that a banknote is a series-E 10,000-yen note, the control unit 50 determines that this banknote is a new version 10,000-yen note. That is, in the version classification setting shown in FIG. 5A, 10,000-yen notes of different two series, i.e., series-D notes and series-E notes, are determined as new version notes.

Thus, in the banknote handling apparatus 1, by utilizing the version classification setting, the same series of banknotes can be handled as new version notes, and can also be handled as old version notes. In addition, multiple series of banknotes can be handled as new version notes. Further, regarding different denominations of the same series, banknotes of a certain denomination can be handled as new version notes while banknotes of another denomination can be handled as old version notes. Moreover, version classification can be freely set for each denomination such that banknotes of a certain denomination are classified into new version notes and old version notes, while banknotes of another denomination are classified into new version notes and older version notes.

The setting operation for the version classification setting is performed by utilizing the operation unit 51 and the display unit 52. FIG. 1 shows an example in which the operation unit 51 and the display unit 52 are separately provided, but the structure of the banknote handling apparatus 1 is not limited thereto. For example, the banknote handling apparatus 1 may be provided with a touch-panel type liquid crystal display unit serving as the operation unit 51 and the display unit 52.

Figure 6:
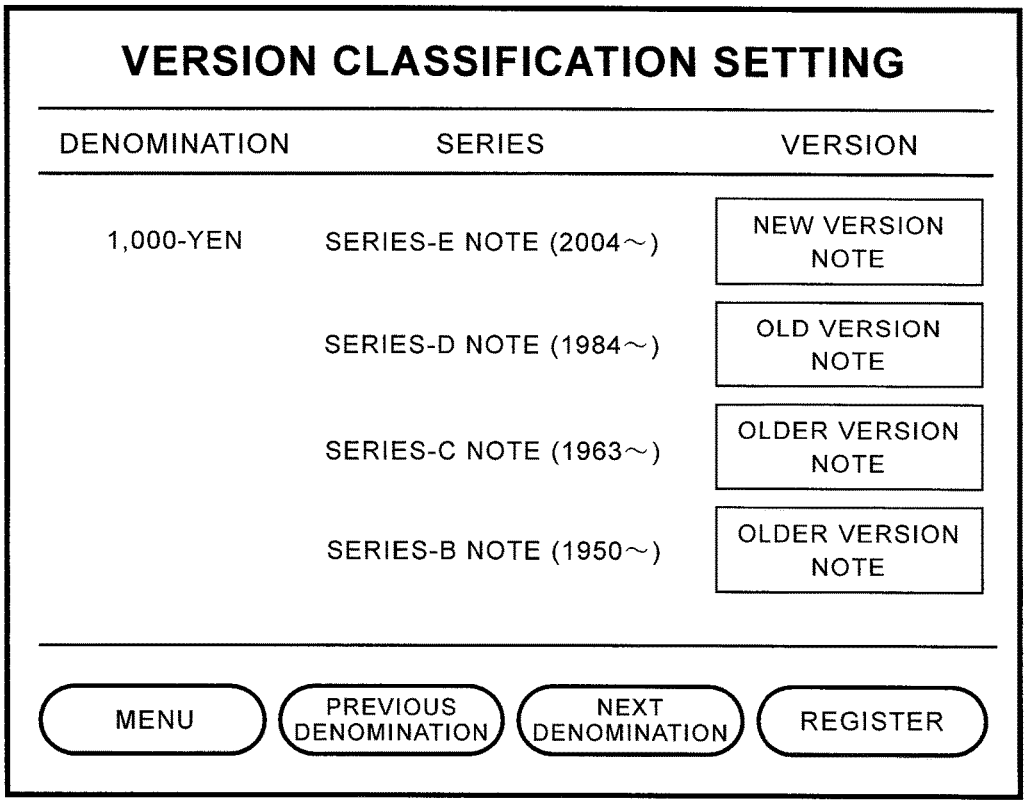
FIG. 6 shows an example of a screen displayed on a display unit when version classification is set.

FIG. 6 shows an example of a screen displayed on the display unit 52 when setting of version classification is performed. When setting version classification, a user operates a predetermined button on a main menu screen for execution of banknote handling such as banknote depositing and dispensing, to call a setting screen for setting of version classification as shown in FIG. 6. On the setting screen, a denomination, information about respective series included in this denomination, and operation buttons are displayed as shown in FIG. 6.

Portions enclosed by rectangles, which are located on a right part of the screen, are buttons used to set version classification of banknotes of the respective series. By operating the operation unit 51 to select each button, the user can designate version classification from among "new version note", "old version note", and "older version note". FIG. 6 shows the setting screen for 1,000-yen notes in the version classification setting shown in FIG. 5B. On this screen, version classification is designated such that series-E 1,000-yen notes are new version notes, series-D 1,000-yen notes are old version notes, and series-C 1,000-yen notes and series-B 1,000-yen notes are older version notes.

For example, the user presses an arrow key included in the operation unit 51 to select the version classification button on the display unit 52, and then presses a version classification change key included in the operation unit 51 to change the version classification on the display unit 52. In the case where the operation unit 51 and the display unit 52 are configured as a touch-panel type liquid crystal display unit, the version classification may be changed between "new version note", "old version note", "older version note" each time the user touches the version classification button displayed on the liquid crystal display unit. Alternatively, a list of version classifications may be displayed when the user touches the version classification button, so that the user can select a version classification from the list.

Portions enclosed by elongated circles, which are located on a bottom part of the screen, indicate command buttons. When the user presses a menu button, the screen returns to the main menu screen for banknote handling. The user can change the banknote denomination displayed on the screen by pressing a previous denomination button or a next denomination button. When the user changes the denomination in order of "10,000-yen note", "5,000-yen note", "2,000-yen note", and "1,000-yen note" by operating the previous denomination button or the next denomination button, information relating to the series of each denomination shown in FIG. 4 is displayed on the screen. Therefore, the user can set version classification for each series of each denomination while confirming this information.

After designating the version classification with the information relating to the series of each denomination being displayed on the screen, the user presses a registration button displayed on the screen, whereby the designated content is registered in the version classification setting and stored in the storage unit 56. At this time, the control unit 50 confirms whether there is inconsistency in the content of designation performed on the screen. Specifically, the control unit 50 confirms whether there is inconsistency between the order of the designated versions and the order of issuance years of money of the respective series, and notifies the user of inconsistency, if any. For example, on the screen shown in FIG. 6, if the series-D note is designated as the new version note while the series-E note issued after the series-D note is designated as the old version note or the older version note, there is inconsistency between the order of the designated versions and the order of issuance years of banknotes of the respective series. Therefore, the control unit 50 displays, on the screen of the display unit 52, information that recommends the user to correct the inconsistency, thereby notifying the user of the inconsistency. Further, when there is inconsistency between the designated version classification and the issuance years of banknotes of the respective series, the control unit 50 controls the operation so that the designated content is not registered in the version classification setting even when the registration button is pressed. In other words, only when there is no inconsistency between the order of the versions designated by the operation unit 51 and the order of issuance of money of the respective series, the control unit 50 registers the designated content in the version classification setting.

In the banknote handling apparatus 1, if the user desires registration of the designated content of the version classification while including the inconsistency of the designated content, the control unit 50 may be operated to accept the registration operation by the user. Specifically, in the case where the control unit 50 is configured to accept the registration operation even when the designated content has an inconsistency, when the registration button is pressed in the state where the version classification is inconsistent with the issuance years of banknotes of the respective series, the control unit 50 displays, on the screen of the display unit 52, the information which notifies the user of the inconsistency, and information which inquires whether or not the designated content including the inconsistency should be registered in the version classification setting. When the user who has confirmed the information on the screen performs an operation to provide an instruction for registration, the control unit 50 registers the designated content in the version classification setting to be stored in the storage unit 56 even though the designated content has the inconsistency.

For example, when the user, in order to collect banknotes of a specific series, designates the banknotes of the specific series as old version notes to be collected, a situation may occur in which the version classification is inconsistent with the issuance years of banknotes of the respective series. Even in this case, if the user who has confirmed that the designated content has the inconsistency again performs a registration operation, the control unit 50 accepts this registration operation.

On the exemplary screen shown in FIG. 6, as information relating to banknotes of each series, information indicating the issuance year of the series is displayed. However, the information to be displayed on the screen can be changed by setting. Specifically, instead of or in addition to the issuance year, an image of a banknote of each series may be displayed. Further, regarding the designation of version classification, in the exemplary screen shown in FIG. 6, banknotes are classified into three versions, i.e., new version notes, old version notes, and older version notes. However, the number of versions into which banknotes are classified may also be changed by a setting. Specifically, version classification may be set so that banknotes are classified into two versions, i.e., new version notes and old version notes. Alternatively, version classification may be set so that banknotes are classified into four or more versions, such as new version notes, old version notes 1, old version notes 2, old version notes 3, etc.

In the storage unit 56 of the banknote handling apparatus 1, the stacking setting in which the types of banknotes to be stacked in the stacking units 60 and the reject units 65 are set, is stored in addition to the version classification setting. FIG. 7 shows a specific example of the stacking setting. As shown in FIG. 7, a plurality of stacking patterns can be set in the staking setting.

By utilizing the operation unit 51 and the display unit 52, the set contents of existing stacking patterns stored in the staking setting can be changed, and deletion and addition of a stacking pattern can be performed. In addition, by selecting a stacking pattern, predetermined types of banknotes can be stacked in the stacking units 60 and the reject units 65 on the basis of the selected stacking pattern.

A stacking pattern 1 shown in FIG. 7 indicates a stacking setting by which new version 10,000-yen notes are stacked in the first stacking unit 60*a*, new version 5,000-yen notes are stacked in the second stacking unit 60*b*, new version 1,000-yen notes are stacked in the third stacking unit 60*c* and the fourth stacking unit 60*d*, undesignated notes are rejected into the first reject unit 65*a*, and counterfeit notes, unrecognizable notes, and suspect notes are rejected into the second reject unit 65*b*. The undesignated notes are genuine banknotes of which denominations and authenticities have been recognized but which are not to be stacked in the first stacking unit 60*a* to the fourth stacking unit 60*d*. In the example of the stacking pattern 1, old version 10,000-yen notes, old version 5,000-yen notes, old version 1,000-yen notes, and 2,000-yen notes are rejected into the first reject unit 65*a* as undesignated notes.

As described above, the versions of banknotes to be stacked in the respective stacking units 60 are designated in the stacking setting. Then, the recognition unit 55 recognizes the denomination and series of each banknote. Thereafter, the control unit 50 determines the version of the banknote on the basis of the version classification setting, and specifies, on the basis of the stacking setting, a stacking unit corresponding to the denomination and version of this banknote as a stacking destination of this banknote.

Specifically, the stacking pattern 1 shown in FIG. 7 is selected as the stacking setting, and the version classification setting is set as shown in FIG. 5A to start banknote handling. Banknotes recognized as series-D 10,000-yen notes by the recognition unit 55 and banknotes recognized as series-E 10,000-yen notes by the recognition unit 55 are determined to be new version notes by the control unit 50 on the basis of the version classification setting shown in FIG. 5A, and are stacked in the first stacking unit 60*a* on the basis of the stacking setting of the stacking pattern 1 shown in FIG. 7. On the other hand, banknotes recognized as series-C 10,000-yen notes are determined as old version notes on the basis of the version classification setting, and are rejected into the first reject unit 65*a* on the basis of the stacking setting.

Regarding 5,000-yen notes, similarly to 10,000-yen notes, series-D 5,000-yen notes and series-E 5,000-yen notes are determined as new version notes and are stacked in the second stacking unit 60*b*, and series-C 5,000-yen notes are determined as old version notes and are rejected into the first reject unit 65*a*, on the basis of the version classification setting shown in FIG. 5A and the stacking setting of the stacking pattern 1 shown in FIG. 7. Regarding 1,000-yen notes, only series-E 1,000-yen notes are determined as new version notes and are stacked in the third stacking unit 60*c* or the fourth stacking unit 60*d*. Meanwhile, series-B 1,000-yen notes, series-C 1,000-yen notes, and series-D 1,000-yen notes are determined as old version notes and are rejected into the first reject unit 65*a*. Further, 2,000-yen notes are determined as new version notes and are rejected into the first reject unit 65*a*.

When the stacking pattern 1 shown in FIG. 7 is selected and the version classification setting is set as shown in FIG. 5A, series-D 10,000-yen notes are determined as new version notes and are stacked in the first stacking unit 60*a*. However, when the version classification setting is set as shown in FIG. 5B with the stacking pattern 1 remaining unchanged, series-D 10,000-yen notes are determined as old version notes and are rejected into the first reject unit 65*a*.

Thus, in the banknote handling apparatus 1, setting of the series of banknotes to be recognized as new version notes is changed in the version classification setting while the stacking setting, by which new version 10,000-yen notes are stacked in the first stacking unit 60*a*, remains unchanged, whereby the series of banknote to be stacked as new version notes in the first stacking unit 60*a* can be changed.

A stacking pattern 2 shown in FIG. 7 indicates stacking setting by which new version 1,000-yen notes are stacked in the first stacking unit 60*a* and the second stacking unit 60*b*, old version 1,000-yen notes are stacked in the third stacking unit 60*c*, older version 1,000-yen notes are stacked in the fourth stacking unit 60*d*, undesignated notes are rejected into the first reject unit 65*a*, and counterfeit notes, unrecognizable notes, and suspect notes are rejected into the second reject unit 65*b*. In the example of the stacking pattern 2, 10,000-yen notes, 5,000-yen notes, and 2,000-yen notes are rejected into the first reject unit 65*a* as undesignated notes, regardless of the versions thereof.

When banknote handling is started with the stacking pattern 2 being selected as the stacking setting and the version classification setting being set as shown in FIG. 5B, banknotes recognized as series-E 1,000-yen notes by the recognition unit 55 are determined as new version notes by the control unit 50 and are stacked in the first stacking unit 60*a* or the second stacking unit 60*b*. Banknotes recognized as series-D 1,000-yen notes are determined as old version notes and are stacked in the third stacking unit 60*c*. Banknotes recognized as series-B 1,000-yen notes and banknotes recognized as series-C 1,000-yen notes are determined as older version notes and are stacked in the fourth stacking unit 60*d*.

Thus, in the banknote handling apparatus 1, banknotes of one denomination are classified into three or more versions, and a stacking destination can be set for each of the versions in the stacking setting. Since classification of versions is designated in the version classification setting and only the versions are designated in the stacking setting, it is possible to easily set classification of versions of banknotes to be stacked in the respective stacking units 60.

As described above, according to the banknote handling apparatus 1 of the present embodiment, for example, both new series banknotes and old series banknotes can be set to be handled as new version notes by utilizing the version classification setting. Thus, in the stacking setting of the banknote handling apparatus 1, both the new series banknotes and the old series banknotes can be stacked in a stacking unit 60 while designating new version notes as banknotes to be stacked in this stacking unit 60. Then, without changing the stacking setting of the banknote handling apparatus 1, only the version classification setting is changed to exclude the old series banknotes from the category of new version notes, whereby only the new series banknotes can be stacked in the stacking unit 60 in which the new series banknotes and the old series banknotes have been stacked.

For example, both the new series banknotes and the old series banknotes are stacked in a stacking unit 60 for banknotes to be reused while circulation of the new series banknotes is small, and banknotes to be stacked in this stacking unit 60 are limited to only the new series banknotes when circulation of the new series banknotes is increased. This setting can be realized by only changing, in the version classification setting, the series of banknotes to be handled as new version notes while the stacking setting of this stacking unit 60 remains as "new version notes".

Also in the case where banknotes are sorted by denominations and stacked in a plurality of stacking units 60, only the denomination and version of banknotes to be stacked in each stacking unit 60 is designated, and the series of banknotes to be handled as new version notes can be designated for each denomination in the version classification setting. At this time, in the version classification setting, a boundary in classification between new version notes and old version notes may be examined and set from a viewpoint of whether banknotes of a certain denomination, which are to be reused, will run out unless old series banknotes of this denomination are handled similarly to new version notes, or only new series banknotes of this denomination are enough for banknotes to be reused. Thus, in the stacking setting, examining and setting operations are facilitated as compared to the case where stacking setting is performed so that new series banknotes are sorted by denominations and stacked in a plurality of stacking units 60 and further it is determined whether or not old series banknotes should be stacked in each stacking unit 60 to which each denomination is assigned.

As described above, the money handling apparatus according to the present invention is useful for easily setting the versions of money to be stacked in the stacking units.

What is claimed is:

1. A banknote handling apparatus including a taking-in unit configured to take in a plurality of banknotes into the banknote handling apparatus, a recognition unit configured to recognize denominations and series of the banknotes taken into the banknote handling apparatus, and a plurality of stacking units configured to stack the banknotes by type based on the recognition result obtained by the recognition unit, the banknote handling apparatus comprising:

a display and operation unit configured to display a setting and to set a new version or an old version for each series of each denomination as a version classification of banknotes;

a storage unit configured to store a version classification setting in which the version classification is set for each series of each denomination by the display and operation unit and to store a stacking setting in which the type of banknotes to be stacked is set for each stacking unit; and a control unit configured to control the plurality of stacking units, based on the version classification setting and the stacking setting stored in the storage unit, to stack recognized banknotes in at least one stacking unit corresponding to the denominations, the new version and the old version, wherein when the new version and the old version are designated for each of multiple series of banknotes by using the display and operation unit, the control unit confirms whether or not there is inconsistency between an order of designated versions and an order of issuance of each series of banknotes, and makes notification of inconsistency if there is any inconsistency.

2. The banknote handling apparatus according to claim 1, wherein the series represents an issuance period during which banknotes having the same design of the same denomination have been issued.

3. The banknote handling apparatus according to claim 1, wherein when multiple series including a first series and a second series of the same denomination are classified as the new version in the version classification setting, the control unit stacks banknotes recognized as the first series by the recognized unit and other banknotes recognized as the second series by the recognition unit in the same stacking unit corresponding to the new version.

4. The banknote handling apparatus according to claim 1, wherein banknotes of the same denomination are classified into three or more versions in the version classification setting.

5. The banknote handling apparatus according to claim 1, wherein denominations and versions of banknotes to be stacked in each stacking unit are set in the stacking setting, and the control unit determines a stacking unit to stack each banknote recognized by the recognition unit based on the stacking setting after the control unit determines the new version or the old version for each banknote recognized by the recognition unit based on the version classification setting.

6. The banknote handling apparatus according to claim 1, wherein when there is no inconsistency between the order of versions designated by the display and operation unit and the order of issuance of each series of banknotes, the control unit registers a designated content in the version classification setting.

* * * * *